US008746757B2

(12) United States Patent
Salo et al.

(10) Patent No.: US 8,746,757 B2
(45) Date of Patent: Jun. 10, 2014

(54) PASSAGEWAY CLOSURE SECURITY APPARATUS

(75) Inventors: John B. Salo, Cumming, GA (US); Ken Taylor, Roswell, GA (US)

(73) Assignee: B&HF Solutions, Inc., Roswell, GA (US)

( * ) Notice: Subject to any disclaimer, the term of this patent is extended or adjusted under 35 U.S.C. 154(b) by 205 days.

(21) Appl. No.: 12/813,099

(22) Filed: Jun. 10, 2010

(65) Prior Publication Data

US 2011/0304164 A1 Dec. 15, 2011

(51) Int. Cl.
*E05C 19/00* (2006.01)

(52) U.S. Cl.
USPC ..... 292/259 R

(58) Field of Classification Search
CPC .... E05C 19/003; E05B 83/10; E05B 15/0093
USPC ..... 292/289, 239, 259 R, 291–296, 292/338–339, DIG. 16, DIG. 19; 16/82, 83; 70/14
See application file for complete search history.

(56) References Cited

U.S. PATENT DOCUMENTS 159,509 A * 2/1875 Haines ..... 292/347
3,919,807 A * 11/1975 Mefford ..... 49/56
4,349,223 A * 9/1982 Spector ..... 292/259 R
4,671,014 A * 6/1987 Lack ..... 49/394
5,232,254 A * 8/1993 Teaff ..... 292/259 R
5,580,108 A * 12/1996 Bergstein ..... 292/259 R
5,669,640 A * 9/1997 Ryan ..... 292/259 R
5,669,641 A * 9/1997 Jeansonne ..... 292/259 R
5,769,145 A * 6/1998 Kwatonowski ..... 160/371
5,799,521 A * 9/1998 Kennedy ..... 70/416
6,102,451 A * 8/2000 Merryman ..... 292/92
7,195,294 B1 * 3/2007 White ..... 292/259 R
2003/0234546 A1 12/2003 Engel
2007/0158957 A1 7/2007 Kramer et al.
2009/0121497 A1 5/2009 Mahala

* cited by examiner

*Primary Examiner* — Kristina Fulton
*Assistant Examiner* — Nathan Cumar
(74) *Attorney, Agent, or Firm* — Jordan IP Law, LLC

(57) ABSTRACT

Methods and apparatuses provide for a security apparatus having a first anchor assembly with a first pin, wherein the first anchor assembly is to be mounted to a wall adjacent to a first side of a passageway closure such as a door or window. A second anchor assembly may include a second pin, wherein the second anchor assembly is to be mounted to the wall adjacent to a second side of the passageway closure. In addition, the security apparatus can include a longitudinal member having an open end and a closed end, wherein if the open end is coupled to the first pin and the closed end is coupled to the second pin, the apparatus inhibits opening of the passageway closure.

10 Claims, 8 Drawing Sheets

PASSAGEWAY CLOSURE SECURITY APPARATUS

BACKGROUND

1. Technical Field

Embodiments generally relate to passageway closure security apparatuses. More particularly, embodiments relate to the use of wall-anchored pins to removably secure a longitudinal brace to a passageway closure such as a door or window.

2. Discussion

Door security techniques such as locks and deadbolts have been used for many years to protect homes and businesses against forced entry. While deadbolts may be appropriate in certain settings, there still remains considerable room for improvement. For example, conventional deadbolts provide additional support for only one side of the doorway, while relying on the hinges to secure the other side of the doorway. In cases of significant force, such a solution may be insufficient to prevent unauthorized entry.

BRIEF DESCRIPTION OF THE DRAWINGS

The various advantages of the embodiments of the present invention will become apparent to one skilled in the art by reading the following specification and appended claims, and by referencing the following drawings, in which:

DETAILED DESCRIPTION

Embodiments may provide for a security apparatus including a first anchor assembly, a second anchor assembly and a longitudinal member. The first anchor assembly may have a first pin, wherein the first anchor assembly is to be mounted to a wall adjacent to a first side of a passageway closure. In addition the second anchor assembly may have a second pin, wherein the second anchor assembly is to be mounted to the wall adjacent to a second side of the passageway closure. The longitudinal member can have an open end and a closed end, wherein if the open end is coupled to the first pin and the closed end is coupled to the second pin, the apparatus may inhibit opening of the passageway closure.

Embodiments may also provide for a longitudinal member having an open end, a closed end and a middle section extending between the open end and the closed end. If the open end is coupled to a first pin of a first anchor assembly mounted to a wall adjacent to a first side of a passageway closure, and the closed end is coupled to a second pin of a second anchor assembly mounted to the wall adjacent to a second side of the passageway closure, the longitudinal member can inhibit opening of the passageway closure.

In addition, embodiments may include an anchor assembly including a wall plate, a stop plate and a pin having a first end coupled to the wall plate and a second end coupled to the stop plate. The stop plate can inhibit movement of an end of a longitudinal member coupled to the pin away from the wall plate.

Figure 1:
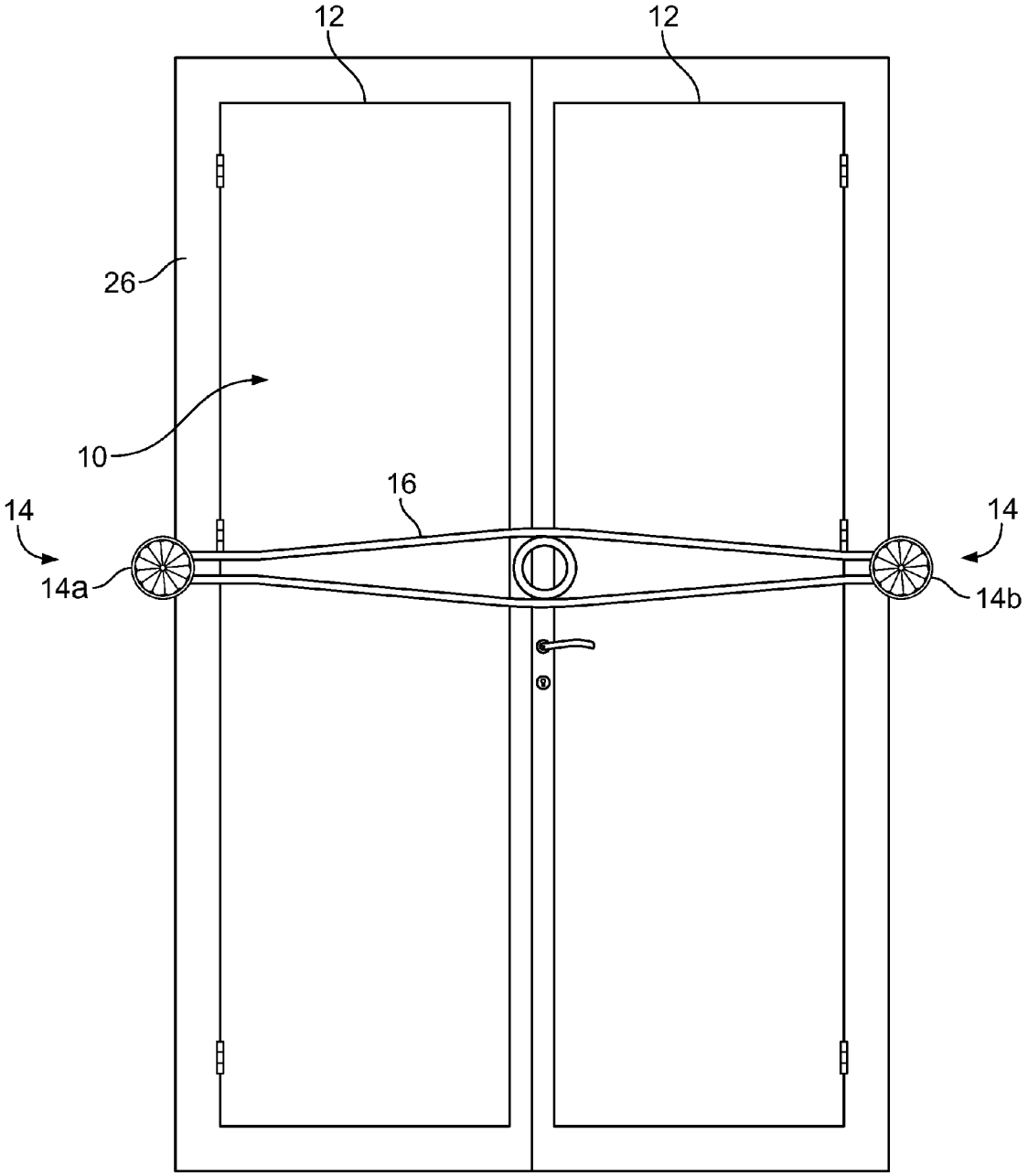
FIG. 1 is a front view of an example of a doorway having a security apparatus with a tapered geometry according to an embodiment.

Turning now to FIG. 1, a security apparatus 10 is shown. In the illustrated example, the apparatus 10 is mounted to a wall containing a passageway closure such as a set of doors 12. The passageway closure could also include a single door, a window, a set of windows, and so on. Generally, the apparatus 10 may include a pair of anchor assemblies 14 (14*a*-14*b*) and a longitudinal member 16, wherein the apparatus 10 can be installed on the hinged side of the doors 12 in order to prevent forced entry from the other side of the doors 12.

Figure 2A:
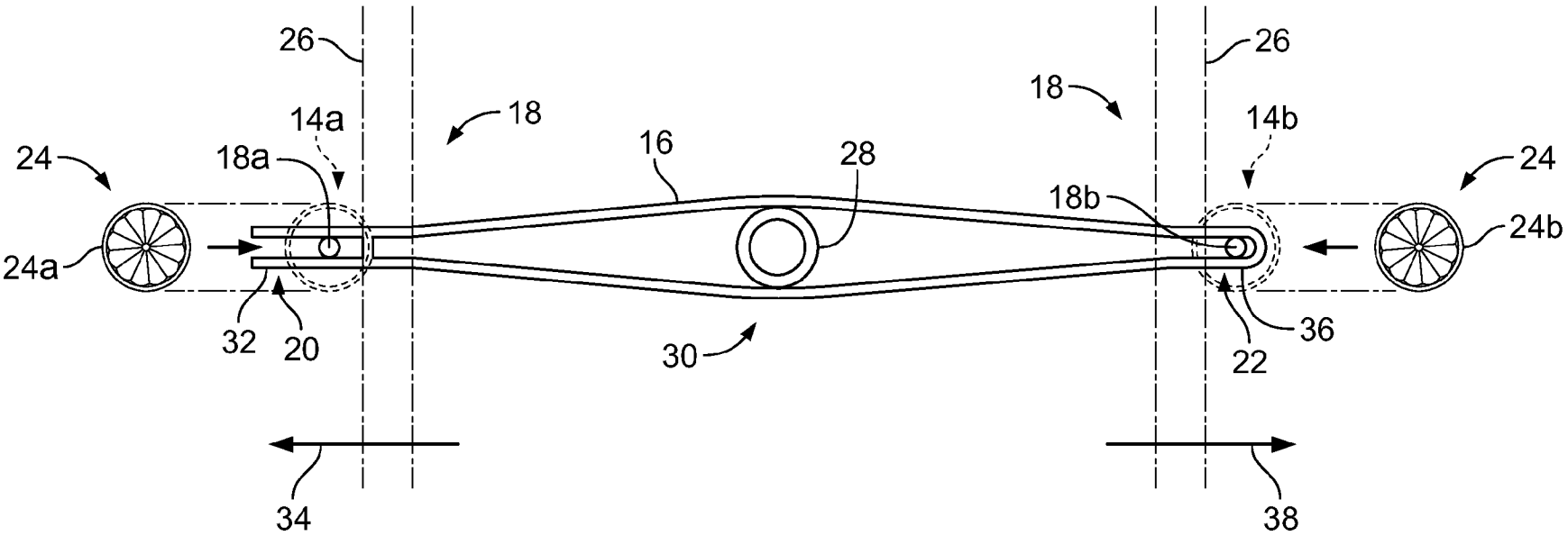
FIG. 2A is an enlarged view of an example of a security apparatus with a tapered geometry according to an embodiment.
Figure 2C:
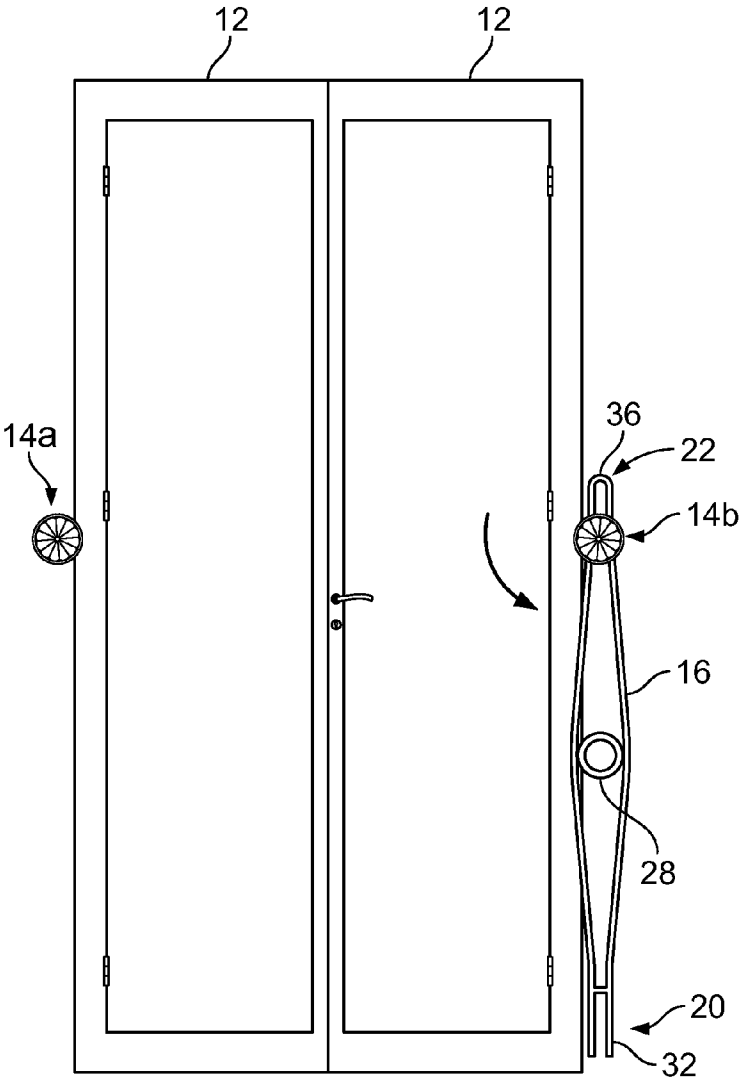
FIG. 2C is a front view of an example of a doorway having a security apparatus in an open position according to an embodiment.
Figure 2B:
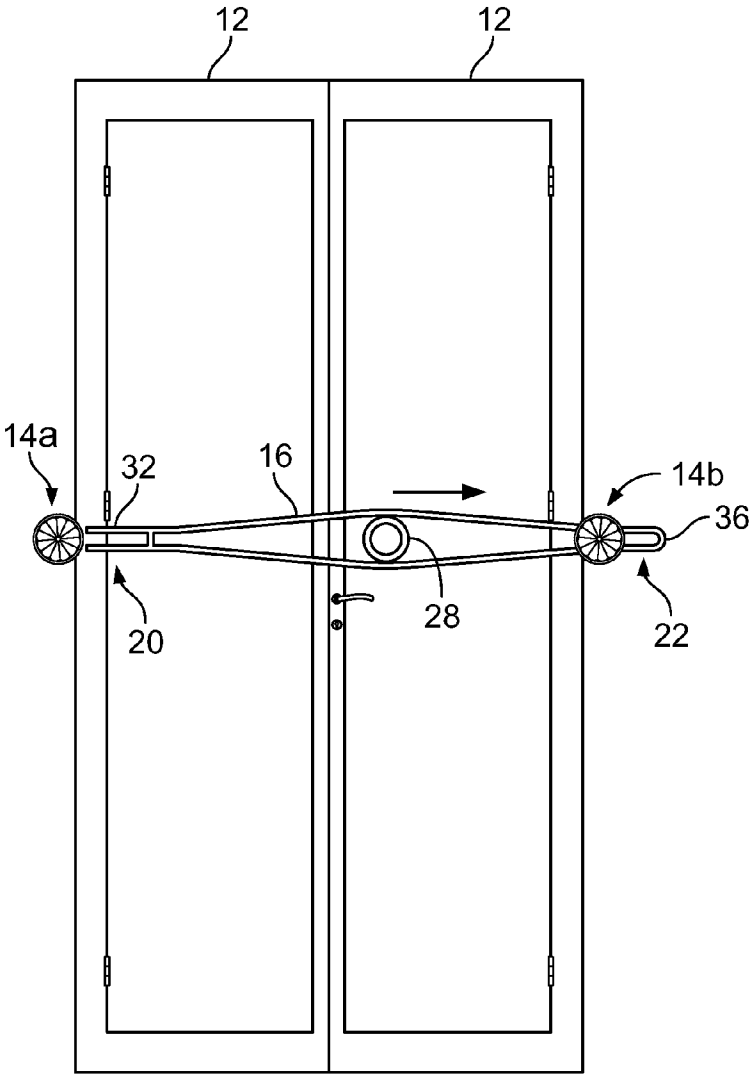
FIG. 2B is a front view of an example of a doorway having a security apparatus in an intermediate position according to an embodiment.

FIGS. 2A-2C demonstrate an example of the construction and operation of the apparatus in greater detail. For example, FIG. 2A shows the longitudinal member 16 in the closed (i.e., locked) position with a portion of the anchor assemblies 14 removed to more clearly illustrate the interaction of the components. In particular, each anchor assembly 14 includes a medallion assembly 24 (24*a*-24*b*) and a pin 18 (18*a*-18*b*) that is anchored to the wall adjacent to the door frame molding 26 of the doors 12 (FIG. 1). The longitudinal member 16, which may include a bar material constructed from steel, aluminum, cast iron, titanium, etc., has an open end 20 and a closed end 22. In the illustrated example, if the open end 20 of the longitudinal member 16 rests on (e.g., is coupled to) the pin 18*a*, and the closed end 22 of the longitudinal member 16 rests on the pin 18*b*, the longitudinal member 16 inhibits opening of the doors 12 (FIG. 1). The longitudinal member 16 can have a middle section 30 with an overall geometry that tapers outward toward a decorative ring 28 in the center of the middle section 30. Other geometries, such as a rectangular or woven geometry, may also be used, as will be discussed in greater detail.

The open end 20 of the illustrated longitudinal member 16 includes a U-shaped section 32 with surfaces defining an opening that faces in an outboard direction 34 of the longitudinal member 16. In addition, the closed end 22 of the longitudinal member 16 includes a slotted section 36 with an inboard portion and an outboard portion, wherein the outboard portion faces in an outboard direction 38. The longitudinal member 16 can be transitioned from the closed position to an intermediate position by passing the pin 18*b* from the outboard portion to the inboard portion of the slotted section 36 and passing the pin 18*a* out of the U-shaped section 32 through its opening (i.e., sliding the longitudinal member to the right in the example shown).

FIG. 2B shows the longitudinal member 16 in the intermediate position, wherein the open end 20 of the longitudinal member 16 is no longer contacting the pin of the anchor assembly 14*a*. FIG. 2C demonstrates that rotating the open end 20 of the longitudinal member 16 downward about the axis of the pin of the anchor assembly 14*b* can transition the longitudinal member 16 from the intermediate position to an open (e.g., unlocked) position. In the illustrated example, the open end 20 of the longitudinal member 16 rests on the floor due to the width of the passageway and the height of the installation location of the anchor assemblies 14. In such a case, the extremities of the U-Shaped section 32 may be coated, covered or otherwise modified with rubber or a similar substance to prevent damage to the floor. In addition, other installations may result in a configuration in which the open end 20 of the longitudinal member 16 does not contact the floor. For example, a single door passageway might result in the length of the longitudinal member 16 being short enough to prevent floor contact, or a window installation of the anchor assemblies 14 might be high enough so that contact with the floor does not occur.

With continuing reference to FIGS. 2A-2C, the longitudinal member 16 could be manufactured by bending a straight piece of bar metal to create the slotted section 36 as well as the outward tapers at the center of the finished product. A smaller piece of the bar metal can also be bent into a circular shape to form the decorative ring 28, which might be welded to the taper bend points. In addition, an even smaller piece of the same material may be cut and welded to the open end 20 to complete the U-shaped section 32 of the longitudinal member 16. Other techniques such as metal stamping and/or molding could be used to formulate the longitudinal member 16.

Figure 3:
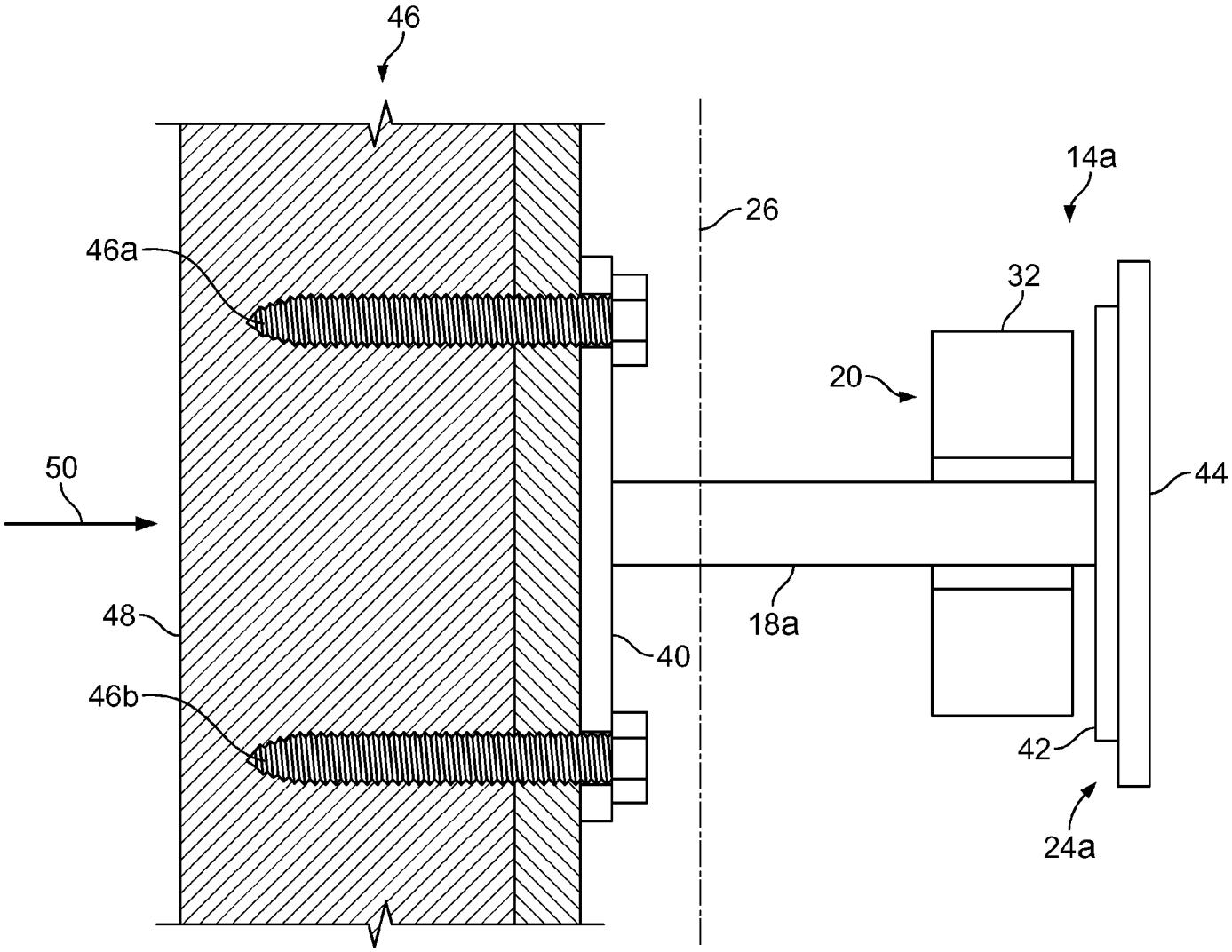
FIG. 3 is a side view of an example of an installed anchor assembly according to an embodiment.

Turning now to FIG. 3, a side view of the anchor assembly 14*a* is shown. The anchor assembly 14*b* (FIGS. 1, and 2A-2C) may have an identical construction as the anchor assembly 14*a*. In the illustrated example, the anchor assembly 14*a* includes a wall plate 40, the pin 18*a*, and the medallion assembly 24*a*, which includes a stop plate 42 and a medallion 44. In one example, the components of the anchor assembly 14*a* are constructed from a robust material such as steel, aluminum, cast iron, titanium, etc., wherein the ends of the pin 18*a* can be welded to the plates 40, 42, and the medallion 44 could be welded to the stop plate 42. Alternatively, the illustrated medallion 44, which serves a decorative function, could be constructed from a less sturdy material and coupled to the stop plate 42 using a different attachment mechanism such as adhesive, etc. In addition, the components of the anchor assembly 14*a* might be formed as an integral piece.

Generally, the stop plate 42 may inhibit movement of the open end 20 of the longitudinal member away from the wall plate 40, wherein plates 40, 42 may be substantially parallel to one another. In particular, the illustrated wall plate 40 has surfaces defining a plurality of openings, through which a corresponding plurality of bolts 46 are extended and screwed into a stud 48 of the passageway closure. Anchoring the pin-based assembly to the studs 48 and using the multi-plate configuration, can provide substantial strength and resistance to forces in the general direction of arrow 50, which may be associated with unauthorized entry.

Figure 4B:
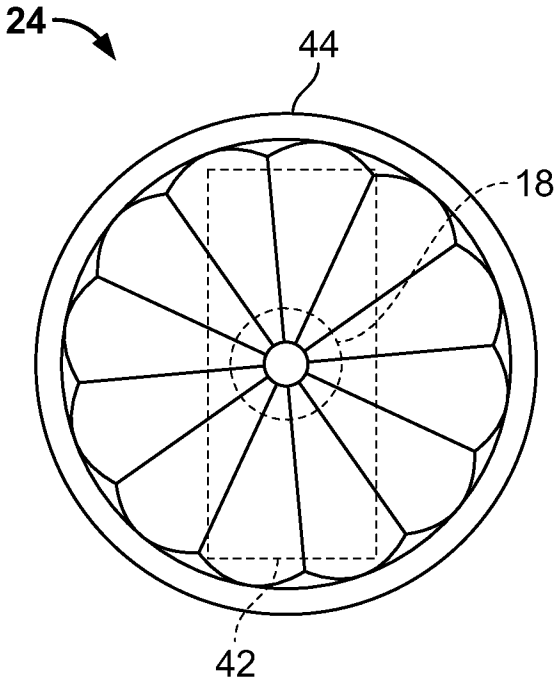
FIG. 4B is a front view of the anchor assembly shown in FIG. 4A.
Figure 4A:
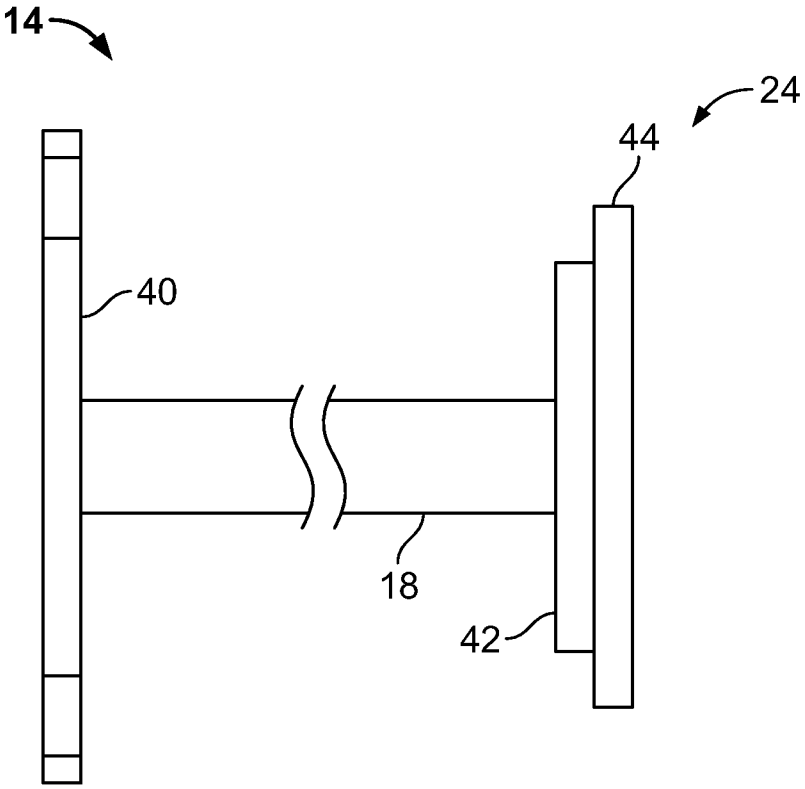
FIG. 4A is a side view of an example of an anchor assembly according to an embodiment.

FIGS. 4A and 4B show one example of the medallion assembly 24 in which the stop plate 42 has a rectangular geometry and the medallion 44 has a circular geometry. The stop plate 42 and medallion 44 could also have other shapes. For example, the stop plate 42 could alternatively have a square or circular geometry and the medallion 44 might have an oval, rectangular or other geometry.

Figure 5:
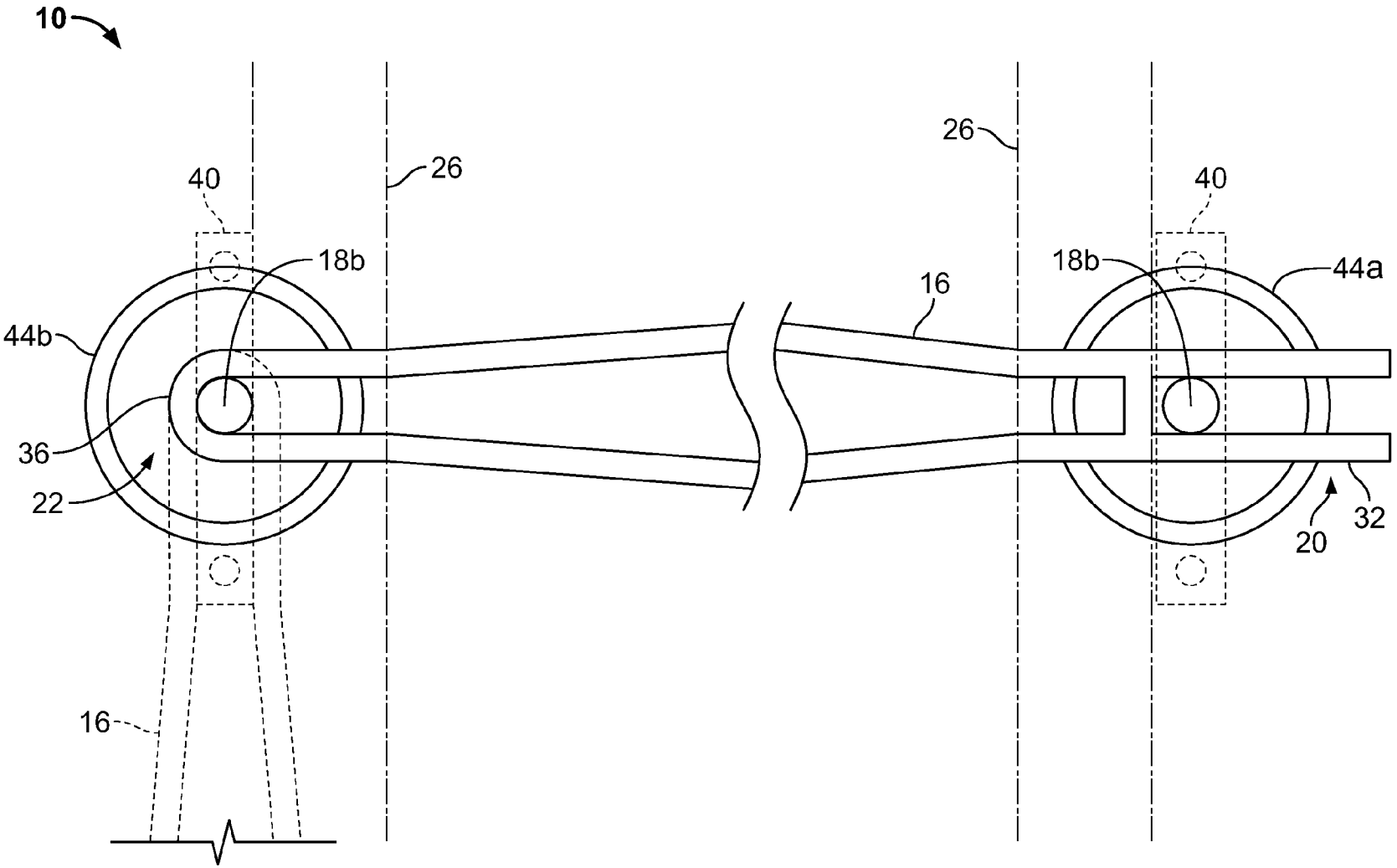
FIG. 5 is a rear view of an example of a security apparatus according to an embodiment.

Turning now to FIG. 5, a rear view of the security apparatus 10 is shown. In the illustrated example, the wall plates 40 have an overall rectangular shape that is similar to that of the stop plates 42 (FIGS. 4A-4B). As already noted, the wall plates 40 could have different shapes.

Figure 6A:
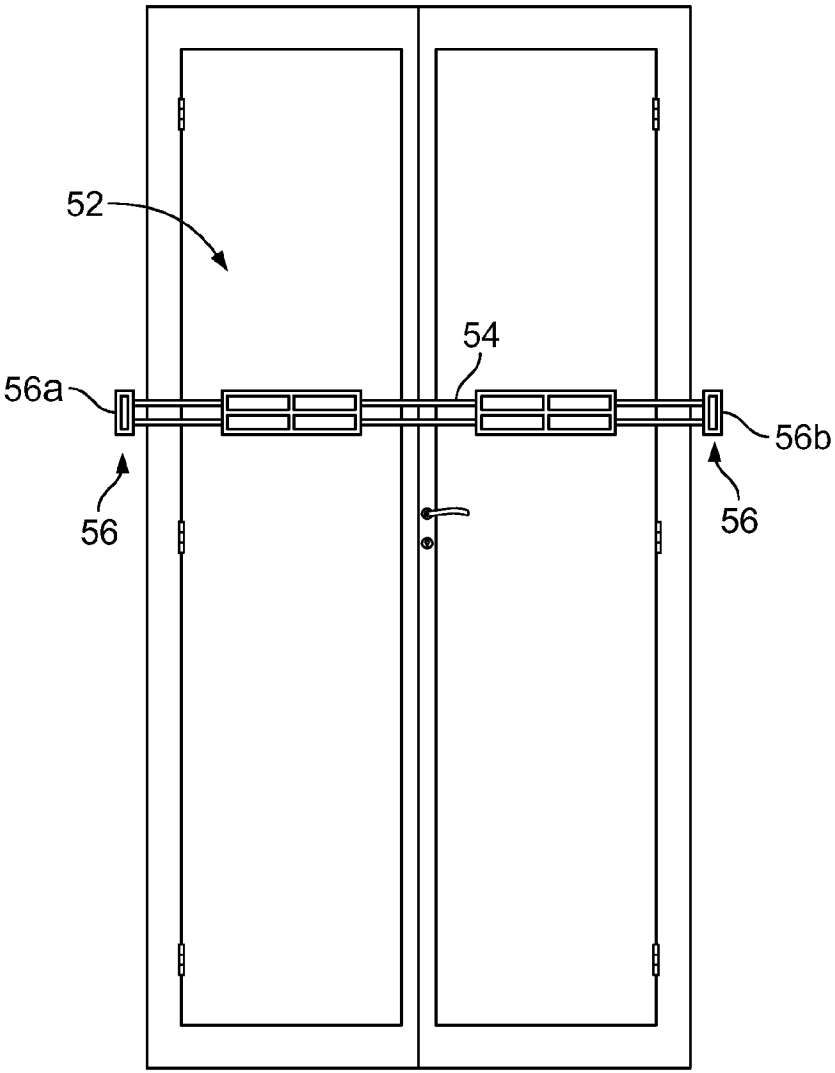
FIG. 6A is a front view of an example of a doorway having a security apparatus with a rectangular geometry according to an embodiment.
Figure 6B:
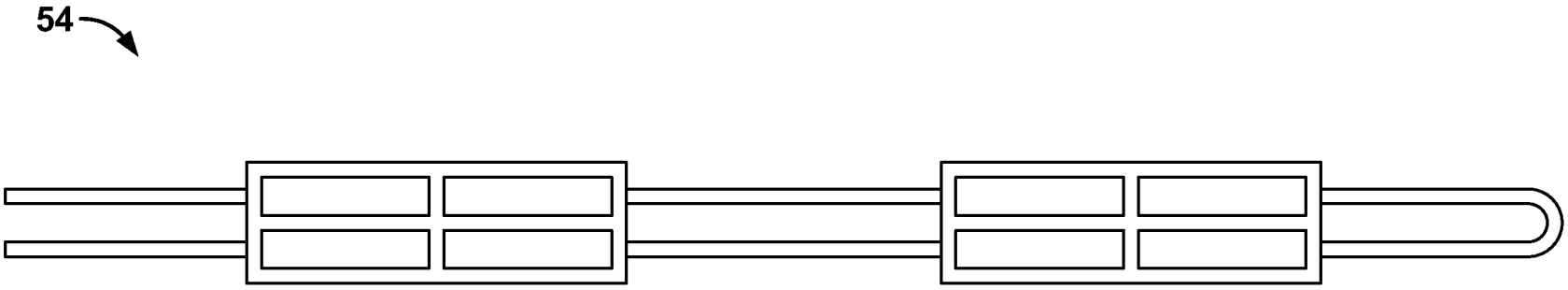
FIG. 6B is a front view of a longitudinal member with a rectangular geometry according to an embodiment.

FIGS. 6A and 6B show an alternative embodiment in which a security apparatus 52 includes a longitudinal member 54 having a middle section with a rectangular geometry. In addition, the illustrated apparatus 52 includes anchor assembly medallions 56 (56*a*-56*b*) having a rectangular geometry.

Figure 7A:
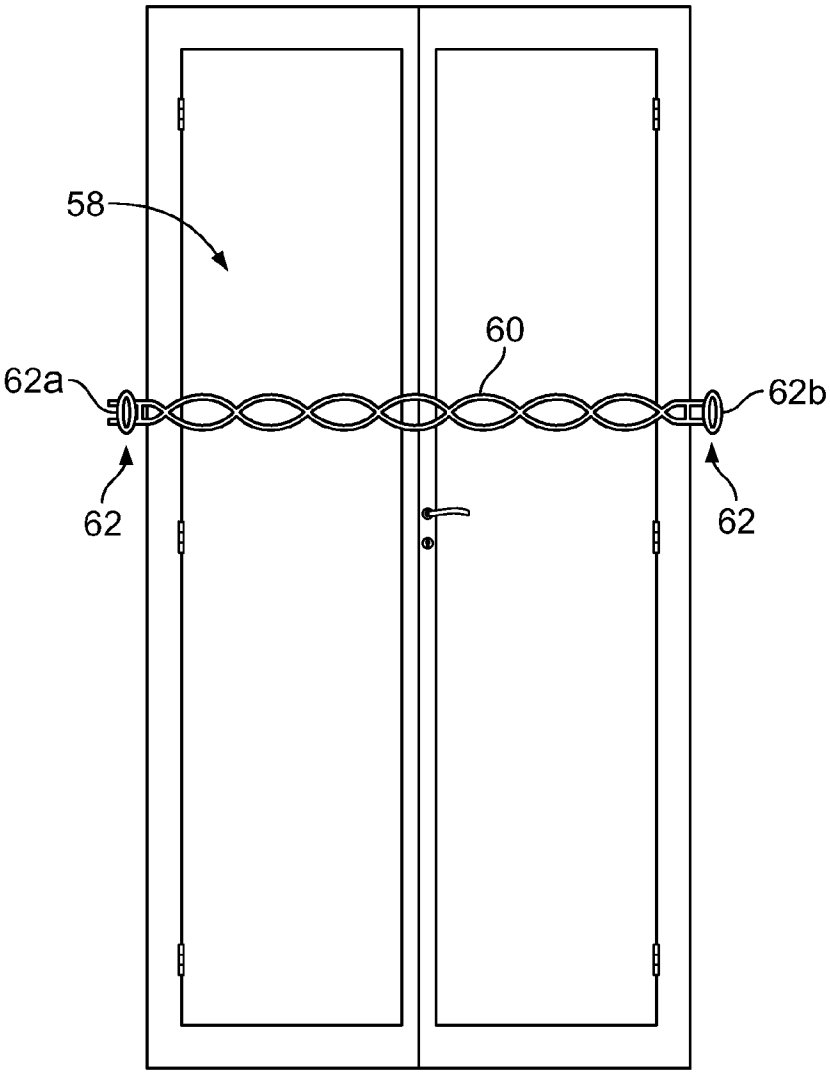
FIG. 7A is a front view of an example of a doorway having a security apparatus with a woven geometry according to an embodiment.
Figure 7B:
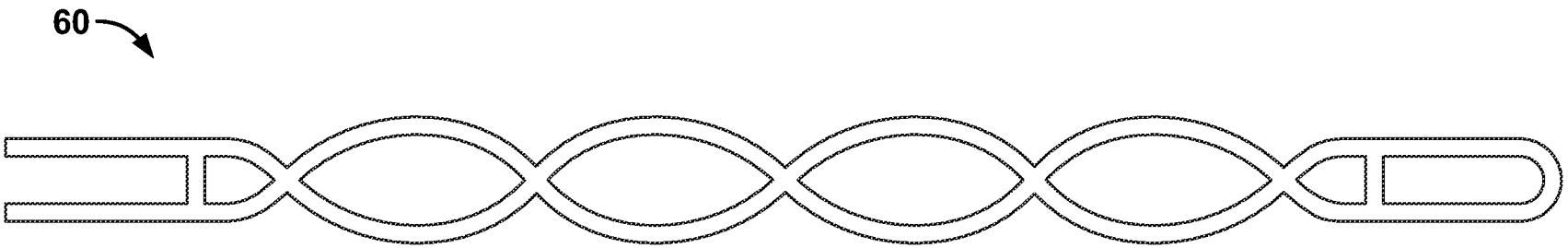
FIG. 7B is a front view of a longitudinal member with a woven geometry according to an embodiment.

FIGS. 7A and 7B show yet another embodiment in which a security apparatus 58 includes a longitudinal member 60 having a middle section with a woven geometry. In addition, the illustrated apparatus 58 includes anchor assembly medallions 62 (62*a*-62*b*) having an oval geometry.

Thus, the passageway security structures and techniques described herein may provide for rugged solutions that are easy to use, and can be manufactured at low cost and under minimal effort. For example, the longitudinal member and anchored pins can enable the security apparatus to withstand high forces while facilitating easy locking and unlocking of the apparatus. In addition, installation can be straightforward and may involve minimal labor.

Example dimensions/sizes/models/values/ranges may have been given, although embodiments of the present invention are not limited to the same. As manufacturing techniques (e.g., welding) evolve over time, it is expected that devices could be manufactured in different and/or more efficient ways. In addition, well known interconnection techniques may or may not be shown within the figures, for simplicity of illustration and discussion, and so as not to obscure certain aspects of the embodiments of the invention. Further, arrangements may be shown in block diagram form in order to avoid obscuring embodiments of the invention, and also in view of the fact that specifics with respect to implementation of such block diagram arrangements can be highly dependent upon the environment within which the embodiment is to be implemented, i.e., such specifics should be well within purview of one skilled in the art. Where specific details (e.g., dimensions) are set forth in order to describe example embodiments of the invention, it should be apparent to one skilled in the art that embodiments of the invention can be practiced without, or with variation of, these specific dimensions. The description is thus to be regarded as illustrative instead of limiting.

The term "coupled" is used herein to refer to any type of relationship, direct or indirect, between the components in question, and may apply to temporary (e.g., sliding), permanent, electrical, mechanical, fluid, ultrasonic, optical, electromagnetic, electromechanical or other connections. In addition, the terms "first", "second", etc. are used herein only to facilitate discussion, and carry no particular temporal or chronological significance unless otherwise indicated.

Those skilled in the art will appreciate from the foregoing description that the broad techniques of the embodiments of the present invention can be implemented in a variety of forms. Therefore, while the embodiments of this invention have been described in connection with particular examples thereof, the true scope of the embodiments of the invention should not be so limited since other modifications will become apparent to the skilled practitioner upon a study of the drawings, specification, and following claims.

We claim:

1. An apparatus comprising:

a longitudinal member having a longitudinal axis with a first end, a second end and an intermediate section extending along the longitudinal axis between the first end and the second end, the first end having an opening at and an axis of the opening extending through a distal end thereof that faces in an outboard direction and coincide with the longitudinal axis of the longitudinal member, the second end being closed and having a slotted section with an inboard portion and the outboard portion;

a first anchor assembly configured for mounting to a wall adjacent to a first side of a passageway closure at the first end of the longitudinal member, the first anchor assembly having a first pin, a first wall plate and a first stop plate coupled to opposing ends of the first pin; and a second anchor assembly configured for mounting to the wall adjacent to a second side of the passageway closure at the second end of the longitudinal member, the second anchor assembly having a second pin, a second wall plate and a second stop plate coupled to opposing ends of the second pin, wherein the longitudinal member is configured for transition between a closed, locked position in which the first pin is received in the opening of the first end and the second pin is received in the slotted section of the second end such that the apparatus inhibits opening of the passageway closure, to an intermediate position in which the second pin passes from the outboard portion to the inboard portion along the longitudinal axis of the longitudinal member to cause the first pin to move out of the opening, and then to an open, unlocked position in which the longitudinal member is rotated downward about the axis of the second pin such that the apparatus permits opening of the passageway closure.

2. The apparatus of claim 1, wherein the opening of the first end of the longitudinal member includes a U-shaped section with surfaces defining the opening that faces in the outboard direction along the longitudinal axis of the longitudinal member, wherein if the first pin passes out of the U-shaped section through the opening, the longitudinal member transitions from the closed, locked position to an intermediate position.

3. The apparatus of claim 1, wherein the intermediate section has at least one of a tapered geometry, a rectangular geometry and a woven geometry.

4. The apparatus of claim 1, wherein the longitudinal member includes at least one of steel, aluminum, cast iron and titanium.

5. The apparatus of claim 1, wherein each wall plate includes:

wall plate surfaces defining a plurality of openings; and a plurality of bolts to extend through the plurality of openings into a stud adjacent to the passageway closure.

6. The apparatus of claim 1, wherein the first wall plate and the first stop plate are substantially parallel to one another, and the second wall plate and the second stop plate are substantially parallel to one another.

7. The apparatus of claim 1, further including a medallion coupled to each stop plate, wherein each medallion has at least one of a circular geometry, an oval geometry and a rectangular geometry.

8. The apparatus of claim 1, wherein the passageway closure includes at least one of a door and a window.

9. A security apparatus for a passageway closure, the security apparatus comprising:

a longitudinal member having a longitudinal axis with a first end having an opening with an axis extending through a distal end of the longitudinal member, that faces in an outboard direction and coincides with the longitudinal axis of the longitudinal member, a closed second end with a slotted section with an inboard portion and the outboard portion, and an intermediate section extending along the longitudinal axis between the first end and the second end;

a first anchor assembly having a first wall plate mounted to the wall adjacent to a first side of the passageway closure, a first stop plate spaced from the first wall plate, and a first pin extending between and connected at opposing ends thereof to the first wall plate and the first end plate;

a second anchor assembly having a second wall plate mounted to the wall adjacent to a second side of the passageway closure, a second stop plate spaced from the second wall plate, and a second pin extending between and connected at opposing ends thereof to the second wall plate and the second end plate, wherein the longitudinal member is configured for transition between a closed, locked position in which the first pin is received in the opening of the first end and the second pin is received in the slotted section of the second end such that the security apparatus inhibits opening of the passageway closure, to an intermediate position in which the second pin passes from the outboard portion to the inboard portion along the longitudinal axis of the longitudinal member to cause the first pin to move out of the opening, and then to an open, unlocked position in which the longitudinal member is rotated downward about the axis of the second pin such that the apparatus permits opening of the passageway closure.

10. A security apparatus for a passageway closure, the security apparatus comprising:

a longitudinal member having a longitudinal axis with a first end having an opening with an axis extending through a distal end of the longitudinal member, that faces in an outboard direction and coincides with the longitudinal axis of the longitudinal member, a closed second end with a slotted section with an inboard portion and the outboard portion, and an intermediate section extending along the longitudinal axis between the first end and the second end;

a first anchor assembly having a first wall plate mounted to the wall adjacent to a first side of the passageway closure, a first stop plate spaced from the first wall plate, a first medallion coupled to the first stop plate, and a first pin extending perpendicular relative to the longitudinal axis of the longitudinal member and connected at opposing ends thereof to the first wall plate and the first end plate;

a second anchor assembly having a second wall plate mounted to the wall adjacent to a second side of the passageway closure, a second stop plate spaced from the second wall plate, a second medallion coupled to the second stop plate, and a second pin extending perpendicular relative to the longitudinal axis of the longitudinal member and connected at opposing ends thereof to the second wall plate and the second end plate, extending and upon which rests the first end of the longitudinal member when the longitudinal member is in a closed, locked position, wherein the longitudinal member is configured for transition between a closed, locked position in which the first pin is received in the opening of the first end and the second pin is received in the slotted section of the second end such that the security apparatus inhibits opening of the passageway closure, to an intermediate position in which the second pin passes from the outboard portion to the inboard portion along the longitudinal axis of the longitudinal member to cause the first pin to move out of the opening, and then to an open, unlocked position in which the longitudinal member is rotated downward about the axis of the second pin such that the apparatus permits opening of the passageway closure.

* * * * *